US005264115A

United States Patent [19]

Mauleon et al.

[11] Patent Number: 5,264,115

[45] Date of Patent: Nov. 23, 1993

[54] PROCESS AND APPARATUS FOR FLUIDIZED BED HYDROCARBON CONVERSION

[75] Inventors: Jean-Louis Mauleon, Marly le Roi; Jean-Bernard Sigaud, Vaucresson; Jean-Claude Courcelle, Montivilliers, all of France

[73] Assignee: Compagnie de Raffinage et de Distribution Total France, Levallois-Perret, France

[21] Appl. No.: 814,249

[22] Filed: Dec. 23, 1991

Related U.S. Application Data

[63] Continuation of Ser. No. 542,803, Jun. 22, 1990, abandoned, which is a continuation of Ser. No. 292,478, Dec. 30, 1988, abandoned.

[30] Foreign Application Priority Data

Dec. 30, 1987 [FR] France ..... 87 18375

[51] Int. Cl.[5] ..... C10G 11/18; C07C 4/06

[52] U.S. Cl. ..... 208/67; 208/72; 208/73; 208/113; 585/374; 585/329; 585/330; 585/648; 585/653

[58] Field of Search ..... 208/113, 49, 67, 72, 208/73; 585/648, 653, 324, 329, 330

[56] References Cited

U.S. PATENT DOCUMENTS

| | | | |
|---|---|---|---|
| 3,240,695 | 3/1966 | Hamner et al. | 208/67 |
| 3,765,851 | 10/1973 | White | 585/651 |
| 3,872,179 | 3/1975 | Andersen et al. | 585/651 |
| 3,954,600 | 5/1976 | Gladrow et al. | 208/120 |
| 4,087,350 | 5/1978 | Kolombus et al. | 585/653 |
| 4,229,586 | 10/1980 | Ward | 585/329 |
| 4,422,925 | 12/1983 | Williams et al. | 208/120 |
| 4,432,863 | 2/1984 | Myers et al. | 208/120 |
| 4,541,923 | 9/1985 | Lomas et al. | 208/120 |
| 4,740,290 | 4/1988 | Tomita et al. | 208/49 |
| 4,802,971 | 2/1989 | Herbst et al. | 208/120 |
| 4,826,586 | 5/1989 | Herbst et al. | 208/120 |
| 4,830,728 | 5/1989 | Herbst et al. | 208/67 |
| 5,009,851 | 4/1991 | Avidan et al. | 585/330 |

FOREIGN PATENT DOCUMENTS

| | | | |
|---|---|---|---|
| 0208609 | 1/1987 | European Pat. Off. | 208/113 |

OTHER PUBLICATIONS

Wuithier, Le Petrole—Raffinage et Genie Chimique, p. 694, Table III-5.1 (1965).

*Primary Examiner*—Anthony McFarlane
*Attorney, Agent, or Firm*—A. Thomas S. Safford

[57] ABSTRACT

The invention relates to a process for the conversion of petroleum hydrocarbons in the presence of catalyst particles in a fluidized phase in an essentially upflow or downflow tubular reaction zone, said process comprising at least one stage of steam cracking of at least one light hydrocarbon fraction and a stage of catalytic cracking of at least one heavy hydrocarbon fraction.

The steam cracking is carried out by contacting the light hydrocarbons and a quantity of steam equal to at least 20 percent by weight in a fluidized bed of the catalyst particles, the resulting temperature ranging from 650° to 850° C.

The catalytic cracking of the heavy hydrocarbons is carried out by contacting them with the effluents from the upstream section of the reaction zone and the catalyst suspension in such a way that the temperature of the mixture ranges from 500° to 650° C. and is then reduced to a temperature ranging from 475° to 550° C.

14 Claims, 1 Drawing Sheet

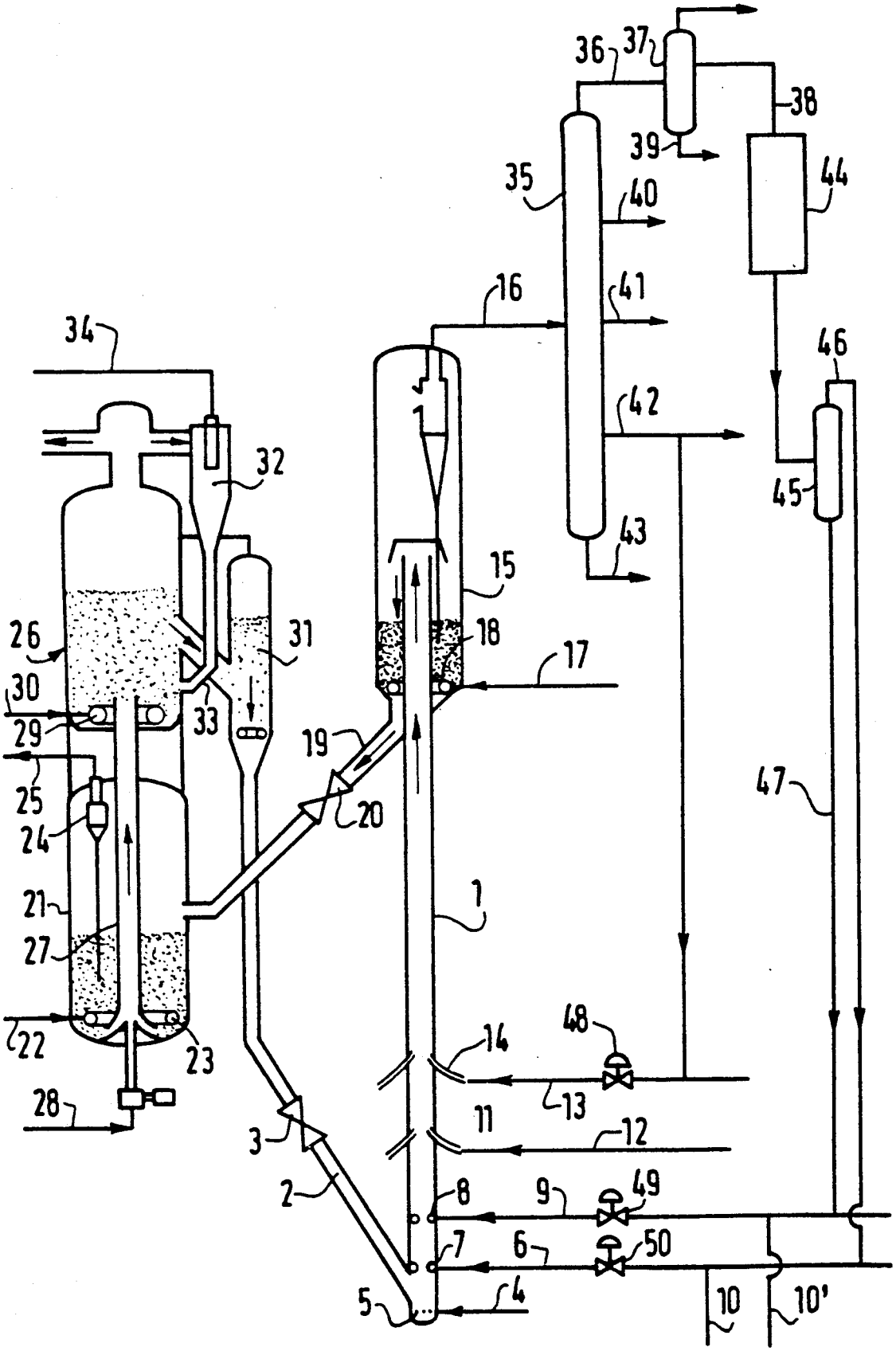
36
37
38
39
35
40
44
16
41
34
46
42
32
45
43
15
26
31
18
17
30
33
29
19
47
25
20
24
1
21
27
48
22
14
23
13
28
11
12
3
2
8
9
49
7
6
50
5
4
10
10'

PROCESS AND APPARATUS FOR FLUIDIZED BED HYDROCARBON CONVERSION

This application is a continuation of application Ser. No. 07/542,803, filed Jun. 22, 1990, now abandoned, which in turn is a continuation of application Ser. No. 07/292,478, filed Dec. 30, 1988, now abandoned.

The present invention relates to a conversion process and apparatus which permit, in the same reaction zone, the catalytic cracking of heavy hydrocarbon feedstocks and the simultaneous production of olefins, and particularly of olefins having from 2 to 4 carbon atoms, by mild steam cracking of light hydrocarbon feedstocks.

It is known that hydrocarbon cracking processes are commonly employed by the petroleum and allied industries. These processes consist in breaking down the hydrocarbon molecules into smaller molecules by raising the temperature. There are two types of cracking, thermal cracking and catalytic cracking, which utilize either the action of heat alone or then the active sites of a catalyst.

In a conventional steam cracking unit, that is, a unit for thermal cracking with steam, the hydrocarbon feedstock is gradually heated in a tube furnace, and the thermal cracking reaction, which on the whole is endothermic, takes place mainly in the portion of the tubes receiving the maximum heat flow. The temperature of these tubes is determined by the nature of the hydrocarbons to be cracked, which usually are ethane or liquefied petroleum gases (LPG), or gasolines or naphthas, and occasionally gas oils (i.e. middle distillates). Regardless of the nature of the feedstock, that temperature is always very high and exceeds 700° C. However, it is limited to a maximum of the order of 850° C. by the conditions under which the process is carried out and by the operating complexity of the furnaces, which use supplementary heating energy. As used in this application, "gas oil" is a literal translation of and is intended to have the same meaning as the French term "gazole," which French-speaking persons of ordinary skill in the art would recognize as being a middle distillate (that is to say a rather light product boiling from 150°-200° C. to 350°-400° C., and typically used as kerosene, home heating oil, diesel motor fuel, and in conventional steam cracking units; [such as mentioned in the preceding paragraph]; and broadly also LCO, i.e. light cycle oil). In U.S. usage the english term "gas oil" is rather ambiguous and, since it can mean atmospheric gas oil and vacuum gas oil, could be a problem if not better defined since in the present invention atmospheric gas oil is used in one section of the reactor and vacuum gas oil in a different section.

In a conventional fluidized-bed catalytic cracking unit, known as a Fluid Catalytic Cracking (FCC) unit, the hydrocarbon feedstock, usually composed of gas oils or heavier stocks such as distillation residues, is contacted with a cracking catalyst that is kept in suspension in the feedstock vapors. After the desired range of molecular weights has been obtained by cracking, with a corresponding lowering of the boiling points, the catalyst is separated from the products obtained, stripped, regenerated by combustion of the coke formed, and then again contacted with the feedstock to be cracked. This catalytic cracking reaction proceeds in a temperature range which generally extends from 450° to 550° C. It is carried out in such a way that the cracking unit is in thermal equilibrium without the use of auxiliary heating energy. In other words, the intake of hot catalyst regenerated by combustion of the coke deposited on it during the reaction should be such that it will be able to meet the diverse heat requirements of the reaction section, and in particular the preheating of the liquid feedstock, the vaporization of that feedstock, and the heat input required by the reactions involved, which on the whole are endothermic.

The steam cracking and catalytic cracking processes thus involve the treatment of hydrocarbon feedstocks of differing nature under reaction conditions which are also different.

The present invention is embodied in processes and apparatus which make it possible to carry out, in the same reaction zone, in a dilute fluidized phase, essentially of the upflow or downflow type, on the one hand a thermal cracking reaction with steam of light hydrocarbon feedstocks, which may include saturated light gases or fractions ranging from gasolines to gas oils, and, on the other hand, a catalytic cracking reaction of heavy hydrocarbon feedstocks where a substantial portion of the boiling range is above 500° C.

It is known, in fact, that the catalytic cracking of heavy hydrocarbon feedstocks (see European patent 208,609, and its equivalent U.S. Pat. No. 4,818,372, owned by the Applicant's Assignee) requires temperatures higher than or equal to the vaporization temperature of the hydrocarbons to permit a subsequent reaction in the gas phase. When the vaporization temperature is considerably higher than the temperature required by the actual cracking reaction, the temperature of the suspension of catalyst particles and hydrocarbons can be reduced, after a controlled contact time, to a level that is better suited for the catalytic cracking reaction, by introducing into that suspension fluids with a lower boiling point, such as light cycle oils (LCO) and heavy cycle oils (HCO).

It is also known that due to their content of compounds such as asphaltenes, resins or polyaromatics these heavy feedstocks tend to produce, under the conditions of the reaction, substantial amounts of coke, which occasionally are well above those required to maintain the heat balance of the unit.

The present invention seeks to utilize this peculiarity of heavy feedstocks, that they produce coke, not only to impart to the catalyst, upon combustion of the coke, the necessary energy for vaporization of the heavy feedstock but also to provide the catalyst with supplementary energy and thus to establish in the upstream portion of the reaction zone the conditions required for performing a mild steam cracking of the lighter hydrocarbons, including in particular ethane, propane, butane, the light gasolines, the naphthas and the gas oils.

The present invention thus has as an embodiment a process for the conversion of petroleum hydrocarbons in the presence of catalyst particles in a fluidized phase in an essentially upflow or downflow tubular reaction zone, said process comprising at least one stage of steam cracking of at least one fraction of light hydrocarbons in the upstream portion of the reaction zone and a stage of catalytic cracking of at least one fraction of heavy hydrocarbons in the downstream portion of the reaction zone, a stage of ballistic separation of the spent catalyst particles, a stage of regeneration of the catalyst in at least one zone for combustion of the coke deposited on its particles, and a stage of recycling of the regenerated particles to the intake of the reaction zone, said process being characterized in that the steam cracking is carried out by contacting the light hydrocarbons and a quantity of steam equal to at least 20 percent by weight, and preferably to from 30 to 50 percent by weight, of the quantity of light hydrocarbons, in a fluidized bed of the catalyst particles, the temperature resulting from such contacting ranging from 650° to 850° C., and preferably from 700° to 800° C., and the catalytic cracking of the heavy hydrocarbons is carried out by contacting them with of the effluents from the upstream portion of the reaction zone and the catalyst suspension in such a way that the temperature of the mixture at first exceeds the vaporization temperature of the feedstock and ranges from 500° to 650° C. and is then reduced to a temperature ranging from 475° to 550° C. by atomizing injection into the reaction zone, immediately downstream of the injection of the heavy feedstock, of a hydrocarbon fraction that is completely vaporizable under the conditions at the exit of the reaction zone.

The light hydrocarbons intended for steam cracking may be introduced into the reaction zone through one or more injection lines, depending on the nature of the hydrocarbons to be steamcracked. In particular, in accordance with an especially advantageous mode of carrying out the process of the present invention, the various hydrocarbon fractions suitable for injection are introduced into the reaction zone one after the other from upstream to downstream in the order of increasing boiling points, the lightest fraction being introduced into the hottest zone. For example, ethane may be introduced first into the upstream section of the reaction zone where the regenerated catalyst is hottest, and gasoline may be introduced into the portion immediately downstream thereof, where the temperature is lower as a result of the ethane being contacted with the catalyst and cracked, but is still high enough for the thermal cracking of the gasoline. The naphtha fractions and then the gas oil (i.e., middle distillate) fractions may subsequently be similarly introduced on the basis of the same principle.

Thus, the steam-cracking portion of the reaction zone may be subdivided into as many sub-portions operating at decreasing severity as there are saturated light hydrocarbon fractions to be steam-cracked.

The quantity of steam injected into the upstream portion of the reaction zone described herein is sizable, in contrast to the usual fluidized-bed cracking conditions. Still, it is significantly smaller than the quantities used in the conventional steam-cracking process, mainly because the process described herein readily adjusts to the possible formation of a certain amount of coke. In fact, the quantity of steam will usually range from 20 to 60 percent by weight, and preferably from 30 to 50 percent by weight, of the quantity of hydrocarbons to be converted by steam cracking. As a result, maintaining a fluidized phase at the temperatures desired for steam cracking requires a heat input that will depend on the quantity of steam is injected into the reaction zone for the purpose of preventing or at least minimizing polymerization of the olefins and diolefins. In accordance with the present invention, this heat input can be obtained by burning the coke produced by the catalytic cracking of a heavy hydrocarbon feedstock from the downstream portion of the reaction zone.

The technological difficulties due in part to the metallurgy of the equipment and in part to problems of catalyst stability at the temperatures required for carrying out the process in accordance with the present invention lead preferably to the use of an apparatus for regeneration of the catalyst which operates with two separate combustion chambers and thus makes it possible to supply the required quantities of catalyst particles at an appropriately high temperature. (See in this connection European patent 184,517, applied for by the Applicant's Assignee in the U.S. as Ser. No. 806,099 on Dec. 6, 1985 and now abandoned.)

A first advantage of the process in accordance with the invention stems from the fact that the steam-cracking reaction in the upstream portion of the reactor requires sizable quantities of heat essentially because of the very pronounced endothermicity of . this reaction (which is from 5 to 10 times that of the catalytic cracking reaction). This substantial heat absorption in the upstream portion of the reactor acts as a heat sink, which manifests itself in an increased catalyst circulation rate, as in every catalytic cracking unit. As a result, the catalytic cracking reaction will be run with a ratio of quantity of catalyst to quantity of feedstock to be cracked (generally called "C/O ratio") that is very much higher than in the prior art (see in this connection European patent 208,609), the gasoline and gas-oil (i.e., middle distillate) yield being consequently improved significantly in relation to the quantity of heavy feedstock to be cracked. In particular, this C/O ratio may advantageously range from 4 to 12 in the downstream portion of the reaction zone.

A second advantage of the process of the invention is that it permits light fractions of limited value, such as ethane or certain gasoline fractions, to be converted to ethylene, propylene and butenes under mild steam cracking conditions with a conversion level slightly lower but a selectivity exceeding that of conventional steam cracking. For example, in accordance with a particularly advantageous mode of practicing the invention, the cracking unit comprises an apparatus for fractionation of the reaction effluents which permits the selective fractionation, in a manner known per se, of said hydrocarbons as well as of the light gases and of the hydrocarbons having two, three or four carbon atoms. It will then be possible in particular to separate the ethane from the other gaseous effluents and to recycle it, possibly in combination with fractions coming from other units, to the hottest portion of the reaction zone, that is, upstream of the injection of gasolines or gas oils (i.e., middle distillates), where the hot regenerated catalyst is introduced.

With this configuration, the mild steam cracking reaction is carried out in the upstream portion of the reactor, in at least two zones of decreasing severity, by injection in the presence of steam of at least two separate fractions, namely, of a fraction containing mainly ethane but possibly also propane and butane, and then of a fraction containing the light gasolines, optionally followed by naphthas or gas oils (i.e., middle distillates).

In accordance with a particularly advantageous mode of carrying out the process of the present invention, the production of propylene may, moreover, be increased significantly by judicious reuse of the hydrocarbons with two carbon atoms produced during the reaction. To this end, it will suffice to use the mixture of ethane and ethylene recovered in a fractionating unit, of a type which is known per se, and to route this mixture to a reactor for the trimerization or oligomerization of the ethylene, for example, of the type described in the prior art (see, in this connection, European patents 12,685, 24,971 and 215,609 or U.S. Pat. No. 4,605,807), for recovery, after fractionation of the effluents of the ethylene oligomerization unit on the one hand, of the unreacted ethane, which will be recycled to the entrance to the upstream portion of the reaction zone, in accordance with the present invention, and, on the other hand, of the light gasolines resulting from such oligomerization, which may in turn be optionally recycled with other gasolines to the steam-cracking zone operated at reduced severity, with a view to increasing the production of propylene and of butenes, if this is the objective to be accomplished.

Still another advantage stemming from the present invention is that the hydrogen necessarily produced by the steam cracking in the upstream portion of the reactor is capable of reacting under the reaction conditions in the downstream portion of the reactor, and hence of improving the yield of the most desired products from the effluents of the conversion unit.

Suitable hydrocarbon fractions to be steam-cracked according to the present invention thus include saturated light gases such as ethane, propane or butanes, or heavier hydrocarbons, whether saturated or not, such as light gasolines, naphthas or gas oils (i.e., middle distillates), even certain fractions with a higher boiling point but highly paraffinic, such as paraffins or slack wax. These hydrocarbon fractions may come either from different units of the refinery, such as the atmospheric distillation, visbreaking, hydrocracking, oil manufacturing or olefin oligomerization units or from the effluents of the conversion unit itself.

The main feedstock injected downstream of the mild steam-cracking zone may be a conventional catalytic cracking unit feedstock, it being possible, however, thanks to the steam-cracking of lighter material, to charge significantly heavier feedstocks.

In addition to vacuum gas oils, a large variety of much heavier feedstocks which can be treated in accordance with the present invention such as crude oils, possibly topped (i.e. possibly with the lighter constituents removed), as well as atmospheric or vacuum distillation residues. These feedstocks may have undergone a prior treatment, if indicated, such as a hydrotreatment, for example. These feedstocks may or may not be diluted with conventional lighter fractions, which may have already undergone a cracking operation and are being recycled, such as cracked gas oils, light cycle oils or heavy cycle oils. In accordance with the present invention, the concentration of very heavy coke precurser compounds in the main feedstock can be increased over what was previously achievable up to a Couradson carbon level in the combined main feedstock of 10 weight percent or higher. Finally, these feedstocks may have been preheated in a temperature range of generally from 100° to 400° C.

All these hydrocarbon feedstocks with a high boiling point can readily be vaporized by appropriate atomization in the reaction zone because of the presence of a large quantity of high-temperature catalyst from the upstream portion of the reaction zone. The heaviest compounds, and in particular the asphaltenes contained in the feedstock, will then be capable of undergoing instantaneous and highly selective thermal cracking, resulting in the formation of lighter products capable of being cracked catalytically in the reaction zone situated downstream.

To this end, the injection of the hydrocarbons into the downstream portion of the reaction zone is carried out by means of high-efficiency atomizers, such as venturi atomizers, to produce liquid droplets of the smallest diameter possible, generally under 100 microns, and preferably under 50 microns. This fineness of atomization actually permits the droplers formed to be vaporized almost instantaneously when contacted with the stream of high-temperature catalyst.

The temperature of the mixture of feedstock and catalyst particles may be as high as necessary for complete vaporization of all constituents of the feedstock while remaining independent of the final catalytic cracking temperature in the zone farther downstream, due to the injection downstream of the principal residual feedstock of another hydrocarbon fraction, such as a liquid HCO or LCO fraction, the latter being injected at such temperature and in such quantity that the temperature prevailing in the rest of the reaction zone can be adjusted so that catalytic cracking is performed under optimum conditions. To this end, the apparatus will comprise means for regulation of the recycle feed rate so that the final reaction temperature is maintained at a desired level appropriate to the feedstock to be cracked, to the cracking conditions, and to the type of reaction desired (for example, to produce gasoline, final temperature 500°-530° C., or to produce gas-oil, final temperature 480°-510° C). The mixture of vaporized feedstock to be cracked and catalyst can thus be maintained at a temperature above the dew point of the feedstock, the cracking temperature being adapted to the selectivity desired for the cracking effluents.

The present invention therefore also has as an embodiment an apparatus for the conversion of petroleum fractions in a fluidized catalytic phase, said apparatus comprising a reaction zone for the contacting at high temperature of petroleum fractions with catalyst particles in an essentially upflow or downflow tubular type of reactor; means for the ballistic separation of the catalyst particles and the cracked fractions; means for stripping the catalyst particles; means for the regeneration thereof by combustion of the coke deposited thereon; and means for recycling the regenerated particles to the intake of the reactor, said apparatus being characterized in that it comprises means for injection of at least one fraction of light hydrocarbons such as saturated light gases, gasolines or middle distillates into the upstream portion of the tubular reactor in the presence of steam in a quantity equal to at least 20 percent by weight, and preferably to from 30 to 50 percent by weight, of the quantity of hydrocarbons, in such a way the resulting mixture is maintained at a temperature ranging from 650° to 850° C. in a dilute fluidized bed; and that it comprises in the downstream portion of the tubular reactor first means for atomization of at least one fraction of heavier hydrocarbons under such conditions that the temperature of the mixture exceeds the vaporization temperature of said hydrocarbons and ranges from 500° to 650° C., as well as second atomization means located immediately downstream of the area of injection of the heavier hydrocarbons, for the purpose of injection of a hydrocarbon fraction that is completely vaporizable under the conditions at the exit of the reaction zone.

This temperature of the conversion effluents will be held constant at between 475° and 550° C. in particular by atomization downstream of the zone of injection of the heavy feedstock of a given quantity of LCO or HCO. This atomization, like that of the heavy feedstock to be cracked catalytically, will be effected by means of injectors, of a type known per se, permitting droplets to be obtained at the outlet of the injector or injectors of which at least 80 percent have a diameter of less than 100 microns.

It is obvious that many variations of the process in accordance with the invention may be implemented, and that the ratio between the feed rate of the heavy hydrocarbon feedstock introduced into the downstream portion and the feed rate of the lighter hydrocarbons (and, in particular, of ethane and gasoline) introduced into the upstream portion may vary considerably, for example, in a ratio of from 0.20 to 1.50 by weight.

To carry out the process in accordance with the present invention, any kind of catalyst having catalytic cracking capacity may be employed. One particularly advantageous category is that of catalysts having porous structures in which the molecules can be contacted with the active sites in the pores. This category includes primarily the silicates or aluminosilicates. Zeolite-containing catalysts in particular are available commercially with supports incorporating a variety of metallic oxides and combinations of such oxides, especially silica, alumina, magnesia, oxides of titanium and barium, and mixtures of these substances, as well as mixtures of these oxides with clays, whether bridged or not. The composition of the catalyst may, of course, include one or more agents favoring one stage of the process or another. Thus, the catalyst may, in particular, incorporate agents promoting the combustion of the coke during regeneration.

The present invention will now be described in greater detail with reference to the accompanying single figure, which illustrates the application of the invention to a fluidized-bed conversion unit with an upflow column, or riser, and with two combustion chambers, suitable in particular for the complete regeneration of a catalyst capable of being brought to high temperature.

The apparatus for conversion in a rising fluidized phase shown in that figure comprises essentially a column 1, known as a riser. The latter is supplied at its base, through a line 2, with regenerated catalyst particles in a quantity regulated by means of a valve 3. The regenerated particles are fluidized by the injection of steam or gas, supplied through a line 4 to the base of the riser, by means of a diffuser 5.

Saturated light gases including ethane in particular are then introduced into the column by means of a diffuser 7 supplied through a line 6, supplemented with steam supplied through a line 10. The temperature exceeding 750° C., and preferably 800° C., which prevails in this part of the chamber thus permits the thermal cracking with steam of these saturated light gases. Downstream of this first steam-cracking zone, a gasoline, middle distillate or gas-oil fraction injected by means of a diffuser 8 supplied through a line 9 can, on the other hand, be cracked at a lower temperature level of the order of from 650° to 750° C. Moreover, supplementary steam may be supplied through a line 10'.

The feedstock of hydrocarbons heavier than the gas oils/middle distillate is then introduced into the reactor by means of one or more injectors 11, supplied through a line 12, in such quantity that the temperature prevailing in this part of column 1 is higher than or equal to the vaporization temperature of that feedstock. It will then be advisable to reduce the temperature of the mixture to a value more appropriate to catalytic cracking, that is, of the order of from 475° to 550° C., by the atomization of hydrocarbons such as light cutter stock (LCO) or heavy cutter stock (HCO) with the aid of a line 13 which supplies one or more injectors 14.

The column 1 opens at its top into a vessel 15, which, for example, is concentric therewith and in which the separation of the cracked feedstock on the one hand and the stripping of the of the spent particles on the other hand are carried out. The ballistic separation means, which may or may not be a cyclone, is accommodated in the vessel 15 and the effluent hydrocarbons are discharged through a discharge line 16 provided at the top of the vessel 15, while the spent catalyst particles drop to the bottom of the vessel 15, where a line 17 supplies diffusers 18, disposed uniformly about the base of the vessel 15, with a stripping gas, usually steam. The particles so stripped are discharged to the regenerator through a pipe 19 provided with a control valve 20.

The regenerator shown in this figure comprises a first zone 21 for combustion, in the presence of oxygen, of the coke deposited on the catalyst particles. The coke is thus partially burned with air, injected at the base of the regenerator through a line 22 which supplies a diffuser 23. The gas of combustion is separated from the catalyst particles in a cyclone 24, from which the gas of combustion is discharged through a line 25 while the partially regenerated catalyst particles are transferred to a second stage 26 through a central pipe 27, supplied with air through a line 28. Air may also be fed to the bottom of stage 26 by means of a diffuser 29, supplied through a line 30. The regenerated catalyst particles are discharged laterally to a buffer vessel 31 and recycled through the pipe 2 to the intake of the riser 1. The gases of combustion discharged in the upper part of the chamber 26 are treated in a cyclone 32, which here is external to the chamber and from the base of which the catalyst particles are returned through a pipe 33 to the chamber 26, while the gases of combustion are discharged through a line 34.

Moreover, the reaction effluents leaving the stripping zone through a line 16 are sent to a fractionating device, shown diagrammatically at 35, which makes it possible to separate

- through a line 36, the light gases or dry gases (composed in particular of hydrogen, methane, ethane, ethylene, $C_4$–$C_5$ hydrocarbons, $NH_3$ and $H_2S$), which may then be treated in another fractionating device 37 permitting, in a manner known per se, the separation of the ethane and ethylene through a line 38, and of the $C_4$–$C_5$ hydrocarbons, which leave through a line 39;
- through a line 40, the gasoline fraction, whose boiling range generally extends from the $C_5$ fraction to 160°–220° C;
- through a line 41, the gas-oil fraction, often also called LCO, whose boiling range generally extends from 160°–220° C. (start of fraction) to 320°–380° C. (end of fraction);
- through a line 42, the heavy cutter-stock fraction, often also called HCO, of lower value (base of low-viscosity fuel oil), whose boiling range generally extends from 320°–380° C. (start of fraction) to 480°–500° C. (end of fraction); and, finally, through a line 43, a distillation-residue fraction containing the heaviest products, which are the most difficult to crack, and more or less substantial quantities of catalyst fines. This residue, whose boiling point is generally above 400° C. but which may also include all of the distillation residue with a boiling point higher than 320°-380° C., is generally called catalytic slurry.

In accordance with a particularly advantageous mode of practicing the present invention, the ethane and ethylene from line 38 are introduced into an oligomerization reactor 44. A fractionating device 45 then permits the unreacted ethane and ethylene to be discharged through a line 46, while the light olefinic gasolines, whose boiling point generally ranges from 30° to 100° C., are extracted through a line 47. Line 46 then permits the ethane so recovered to be sent back to the upstream portion of the reactor through the line 6, while the light gasolines may either be utilized as is or then steam-cracked by being recycled into line 9 with a view to maximizing the production of propylene, for example.

Finally, a portion of the HCO from the fractionating zone 35 is here recycled through line 42 to line 13 to regulate the reaction temperature downstream of column 1. This regulation is effected by means of a valve 48 whose delivery is controlled on the basis of the temperature measured by means of a sensor located preferably at the reactor outlet.

Similarly, valves 49 and 50 permit the quantities of light hydrocarbons introduced through lines 9 and 6 into the upstream portion of the reaction zone to be regulated on the basis of the temperature measured in that section so that this temperature, which ranges from 650° to 850° C., will permit the steam cracking to be carried out there in accordance with the present invention.

EXAMPLE

The tests described below were run with a straight-run gasoline fraction and a feedstock A in a single rising fluidized-phase unit having two regeneration zones, of the type shown in FIG. 1. The feedstock A was an atomospheric residue of a crude of the Shengli type.

The characteristics of these feedstocks were as follows:

| | GASOLINE | FEED-STOCK A |
|---|---|---|
| Gravity (at 15° C.) | 0.675 | 0.955 |
| Vol % distilled at 50° C. | 20 | — |
| Vol % distilled at 70° C. | 70 | — |
| Vol % distilled at 100° C. | 99 | — |
| Wt. % distilled at 450° C. | — | 20 |
| Wt. % distilled at 550° C. | — | 45 |
| Wt. % distilled at 650° C. | — | 70 |
| Paraffins/naphthenes/aromatics, wt. % | 77/17/6 | — |
| $H_2$, wt. % | 15.4 | 12.1 |
| S, wt. % | — | 1.0 |
| Total N, wt. % | — | 0.6 |
| C, wt. % | — | 8.1 |
| Ni + V, ppm | — | 40 |

A commercial catalyst was used which comprised ultrastabilized zeolites and a matrix suitable for cracking the heaviest hydrocarbon molecules. The conditions of this test, in which ethane and gasoline were successively injected into the upstream portion of the reaction zone and feedstock A and a given quantity of HCO were then successively injected into the downstream portion, were as follows:

| | |
|---|---|
| Upstream portion of the reactor zone of riser (with mild stream cracking conditions): | |
| Injection of ethane | |
| Temperature of regenerated catalyst, °C. | 800 |
| Feed rate of regenerated catalyst, tons/hour | 720 |
| Feed rate of steam at 320° C., tons/hour | 40 |
| Feed rate of ethane, tons/hour | 5 |
| Temperature of mixture, °C. | 785 |
| Injection of gasoline | |
| Feed rate of steam at 320° C., tons/hour | 1 |
| Feed rate of gasoline at 150° C., tons/hour | 20 |
| Temperature of mixture, °C. | 725 |
| Downstream portion of the reactor zone of riser (with conventional calalytic cracking conditions): | |
| Injection of feedstock | |
| Feed rate of steam at 320° C., tons/hour | 2.5 |
| Feed rate of feedstock at 380° C., tons/hour | 100 |
| Temperature of mixture, °C. | 575 |
| Injection of HCO recycle | |
| Feed rate of HCO at 200° C., tons/hour | 25 |
| Feed rate of steam at 320° C., tons/hour | 0.5 |
| Temperature of mixture, °C. | 530 |
| Temperature at end of reaction, °C. | 525 |

After recovery of the conversion-reaction effluents, their nature was analyzed. The results of that analysis (in weight percent, based on the total quantity of hydrocarbons to be converted, that is, based on the ethane, the gasoline and the atmospheric residue) alone demonstrate the advantages of the present invention over the conventional processes. These results are as follows:

| | Weight percent |
|---|---|
| $H_2S + NH_3$ | 0.7 |
| $H_2$ | 0.4 |
| $C_1$ | 2.8 |
| $C_2$ | 3.1 |
| $C_2$ (olefinics) | 6.8 |
| $C_3$ | 1.0 |
| $C_3$ (olefinics) | 6.1 |
| $C_4$ | 2.6 |
| $C_4$ (olefinics) | 6.6 |
| $C_5$-220° C. fraction | 39.3 |
| 220-360° C. fraction | 18.5 |
| 360° C. + fraction | 4.4 |
| Coke | 7.7 |

This specification is based upon a French priority document, France—No. 87.1375, filed Dec. 30, 1987, which is incorporated herein by reference.

We claim:

1. A process for the conversion of petroleum hydrocarbons in the presence of catalyst particles in a fluidized phase in an essentially upflow or downflow tubular reaction zone, said process comprising the steps of:

steam cracking of a light feedstock having at least one fraction of light hydrocarbons, including at least ethane or propane, in a first, upstream portion of said reaction zone, said steam cracking being carried out by contacting the light hydrocarbons and a quantity of steam equal to at least 20 percent by weight of the quantity of said light hydrocarbons in a fluidized bed of the catalyst particles, the temperature resulting from such contacting ranging from 650° to 850° C. and whereby said contacting results in a hydrocarbon-containing effluent from said first portion which contains olefins including ethylene or propylene, and, said olefins are obtained in excess of alkanes present in the light feedstock;

atomizing and injecting a heavy feedstock of at least one fraction of heavy hydrocarbons in a second portion of the reaction zone into the effluents from the first, upstream steam-cracking portion of said reaction zone, which effluents include the fluidized catalyst particles, in such a way that the temperature of the resulting mixture ranges from 560° to 650° C. and wherein said temperature on contact is sufficient to vaporize the heavy feedstock;

immediately downstream of the injection and vaporization of said heavy feedstock in the second portion of the reaction zone, atomizing and injecting into the effluents from said second portion of the reaction zone in a third portion of the reaction zone a hydrocarbon fraction that is completely vaporizable under conditions existing at the exit of the reaction zone so as rapidly to reduce the temperature of the resulting mixture to a more effective catalytic cracking temperature ranging from 475° to 550° C. in the resulting third downstream portion of said reaction zone;

thereafter, catalytically cracking at least said vaporized heavy hydrocarbons in said third, downstream portion of said reaction zone;

ballistically separating spent catalyst particles emanating from said third, downstream catalytic cracking portion of said reaction zone;

regenerating of the separated catalyst particles in at least one zone for combustion of the coke deposited on such particles; and recycling the regenerated particles to the intake of the first, upstream cracking portion of said reaction zone.

2. A process as defined in claim 1, wherein the light hydrocarbon fractions fed to the first upstream steam-cracking portion of the reaction zone include in addition to ethane or propane, at least one fraction introduced in a downstream part of the first portion and selected from the group consisting of saturated light gases other than the ethane or propane, gasolines, naphthas, gas oils, and middle distillates, wherein said middle distillates are predominantly hydrocarbons having carbon numbers predominantly in the range of C9 to C20 and boiling in the range of approximately 150° C. to 400° C.

3. A process as defined in claim 2, wherein the light hydrocarbons are injected successively from upstream to downstream in the steam cracking portion of the reaction zone in the order of increasing boiling points, the lightest fraction being introduced into the hottest zone.

4. A process as defined in claim 1, wherein the steam cracking is carried out by contacting the light hydrocarbons and a quantity of steam equal to from 30 to 50 percent by weight of the quantity of light hydrocarbons in a fluidized bed of the catalyst particles.

5. A process as defined in claim 1, wherein the heavy feedstock fed to the downstream catalytic cracking portion of the reaction zone includes an atmospheric-residue or a vacuum-residue of which at least 20 percent by weight have a boiling point above 550° C.

6. A process as defined in claim 1, wherein the hydrocarbons atomized immediately downstream of the injection of the heavy feedstock are substantially comprised of heavy cycle oil or light cycle oil recycles from a fractionation distillation of the effluents from the reaction zone.

7. A process as defined in claim 1, wherein the hydrocarbons injected into the downstream catalytic cracking portion of the reaction zone are atomized to form droplets of which at least 80 percent have a diameter of less than 100 microns.

8. A process as defined in claim 1, wherein the catalyst particles are regenerated by combustion of the coke deposited thereon in two separate combustion chambers, each of which has its own means for discharging the gaseous effluents.

9. A process as defined in claim 1, wherein the ratio of the quantity of catalyst to the quantity of heavy feedstock to be cracked ranges from 4.0 to 12.0 in the downstream section of the reaction zone.

10. A process as defined in claim 1, wherein ethylene from a fractionation of the reaction effluents is sent to an oligomerization reactor whose effluents, other than light gasolines, are recycled to the upstream portion of the reaction zone.

11. The process of claim 1, wherein the catalyst to lift gas ratio is about 11.

12. The process of claim 1 wherein the ethylene is obtained in a quantity of at least twice the quantity of ethane in the light feedstock.

13. The process of claim 12 wherein the propylene is obtained in a quantity of at least six times the quantity of the propane in the light feedstock.

14. The process of claim 1 wherein olefins including ethylene and propylene are obtained from the hydrocarbon-containing effluent;

and the process further comprises subjecting the ethylene thus obtained to oligomerization to obtain an oligomerization product, and recycling the oligomerization product into the light hydrocarbons of the steam cracking step, so that the oligomerization product is selectively cracked into propylene, thereby enhancing the propylene yield of the process.

* * * * *